US005365862A

United States Patent [19]

Peterson

[11] Patent Number: 5,365,862

[45] Date of Patent: Nov. 22, 1994

[54] TABLE HEIGHT ADJUSTING MECHANISM

[75] Inventor: Warren J. Peterson, Stevens Point, Wis.

[73] Assignee: Joerns Healthcare Inc., Stevens Point, Wis.

[21] Appl. No.: 988,416

[22] Filed: Dec. 9, 1992

[51] Int. Cl.[5] ..... A47B 9/00

[52] U.S. Cl. ..... 108/144; 240/188.2

[58] Field of Search ..... 108/144, 147, 150; 240/188.5, 188.4, 188.2, 157

[56] References Cited

U.S. PATENT DOCUMENTS

| | | | |
|---|---|---|---|
| 270,263 | 1/1883 | Tix . | |
| 1,229,138 | 6/1917 | Reischmann . | |
| 1,899,835 | 2/1933 | Thum . | |
| 2,217,031 | 10/1940 | Sutton . | |
| 3,207,099 | 9/1965 | Black et al. | 108/147 X |
| 3,347,511 | 10/1967 | Myers | 108/147 X |
| 3,358,620 | 10/1967 | Parigi . | |
| 3,517,625 | 6/1970 | Swett . | |
| 3,525,492 | 8/1970 | Friedman et al. . | |
| 3,707,930 | 1/1973 | Yindra et al. | 108/147 |
| 3,733,623 | 5/1973 | Croxton . | |
| 3,877,088 | 4/1975 | Bouman . | |
| 3,968,755 | 7/1976 | Lester . | |
| 4,195,578 | 4/1980 | Benoit et al. | 108/144 |
| 4,352,479 | 10/1982 | Chapman, Jr. . | |
| 4,381,714 | 5/1983 | Henneberg et al. | 108/144 X |
| 4,667,605 | 5/1987 | Bastian | 108/144 |
| 4,774,732 | 10/1988 | Riedl . | |
| 4,805,542 | 2/1989 | Peterson et al. | 108/147 X |
| 4,809,685 | 3/1989 | Barnes . | |
| 4,828,208 | 5/1989 | Peterson et al. | 108/147 X |
| 4,936,554 | 6/1990 | Heyward . | |
| 5,224,429 | 7/1993 | Borgman et al. | 108/147 |

FOREIGN PATENT DOCUMENTS

| | | |
|---|---|---|
| 1230459 | 5/1971 | United Kingdom . |

*Primary Examiner*—José G. Chen

*Attorney, Agent, or Firm*—Price, Heneveld, Cooper, DeWitt & Litton

[57] ABSTRACT

A mounting apparatus for supporting a table top on having an elongated support member, includes a housing adapted to be attached to the table top and at least one guide plate. The guide plate includes an aperture which engages the support member. The guide plate is angularly adjustable and positioned to secure the guide plate in a fixed position in engagement with the base.

20 Claims, 4 Drawing Sheets

TABLE HEIGHT ADJUSTING MECHANISM

BACKGROUND OF THE INVENTION

The present invention relates to tables and the like, and in particular to a portable table that is especially adapted for institutional settings such as hospitals, schools, general dining halls, nursing homes, and the like.

Tables are often employed in institutional environments for a variety of different uses such as dining, crafts, and games. These institutions include health care facilities such as hospitals, nursing homes, and the like. In these facilities, patients often have wheelchairs, geriatric chairs, and other similar special purpose seats. Separate tables are normally provided to accommodate the additional height required for such chair restricted residents. However, the use of special tables for chair restricted residents tends to segregate patients since chair restricted residents will utilize different tables than non-chair restricted residents. Although some types of fixed height tables are provided with cutout areas in the apron to accommodate wheelchairs, the fixed height is typically at a compromise level that is not entirely satisfactory or comfortable for either the wheelchair patient or the ambulatory resident.

It is preferable that tables in health care institutions have some type of mechanism to adjust the height of the top, so that the table can accommodate all types of users. Preferably, the top is easily raised and lowered while still providing a secure support for the top. High-low adjustment permits residents in wheelchairs and geriatric chairs to be seated with people in conventional chairs at any table they desire in the room. Although high-low adjustment mechanisms have been used on some types of horizontal supports, they are typically quite complex in construction and/or do not provide stable support for the top.

A particularly advantageous high-low adjustment mechanism for a table is disclosed in commonly owned, U.S. Pat. No. 4,828,208, entitled VERTICALLY ADJUSTABLE TABLE WITH RETRACTABLE CASTER ASSEMBLY which issued on May 9, 1989 to Peterson et al. In one embodiment disclosed therein, the high-low adjustment mechanism is utilized on a table including a caster. The caster facilitates manual transporting of the table by a single person of average strength and dexterity with relative ease and safety. The Peterson et al. patent discloses a height adjustment mechanism having a housing including two plates which are attached to a tubular support column using bolts. The bolts clamp the plates to the support column. Although the high-low adjustment mechanism disclosed in the Peterson et al. patent overcomes many of the disadvantages of prior art units by providing a height adjustment mechanism which is stable and easy to operate and install, it remains desirable to provide further improvements in the mounting apparatus associated with the height adjustment mechanism. In some situations, such as during movement of the table, severe twisting and racking forces experienced by the table top are translated through the housing plates and bolts.

SUMMARY OF THE INVENTION

The mounting apparatus of the immediate invention includes at least one plate that provides a stable table top support, which resists twisting and racking forces and facilitates the ease of installation and operation of a height adjustment mechanism associated therewith. According to one aspect of the invention, a mounting apparatus for supporting a table top on a base includes a housing adapted to be attached to the table top and at least one guide plate. The guide plate includes an aperture adapted to engage the support member. The guide plate is moveable and locking members are used to secure the guide plate in a fixed position in engagement with the base. According to one embodiment of the invention the connector housing is connected to a table top and the guide plate engages a support member in the base.

The mounting apparatus provides a connector for supporting a table top on a base which is free from shake or wobble and is resistant to racking and twisting forces of the table. These and other features, advantages and objects of the present invention will be further understood and appreciated by those skilled in the art by references following written specification, claims, and appended drawings.

DETAILED DESCRIPTION OF THE PREFERRED EMBODIMENTS

Figure 1:
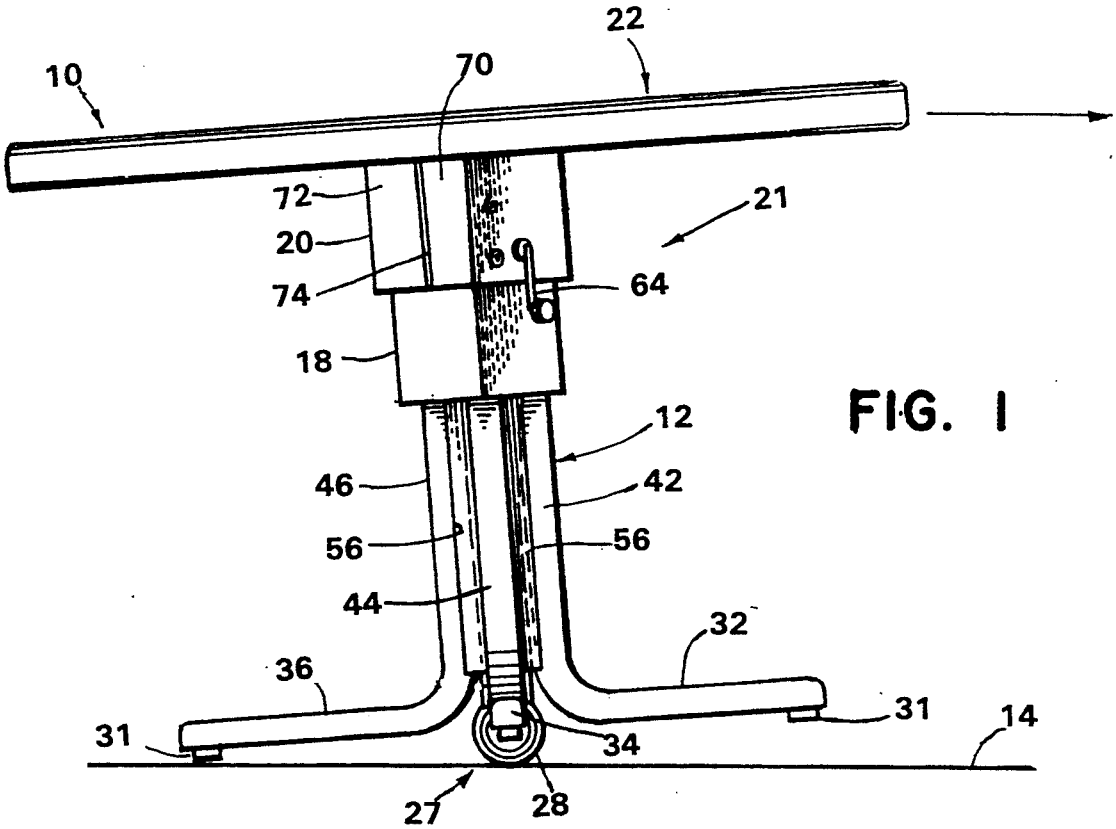
FIG. 1 is a front elevational view of a table embodying the present invention shown with a retractable caster in an "on" position, and the table being transported across the support surface.

For purposes of description herein, the terms "upper," "lower," "right," "left," "rear," "front," "vertical," "horizontal" and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
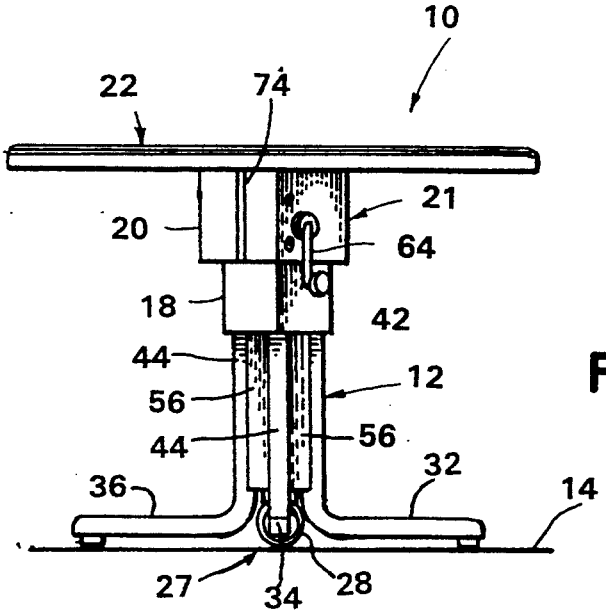
FIG. 2 is a front elevational view of a table shown with the caster in an "off" position.
Figure 4:
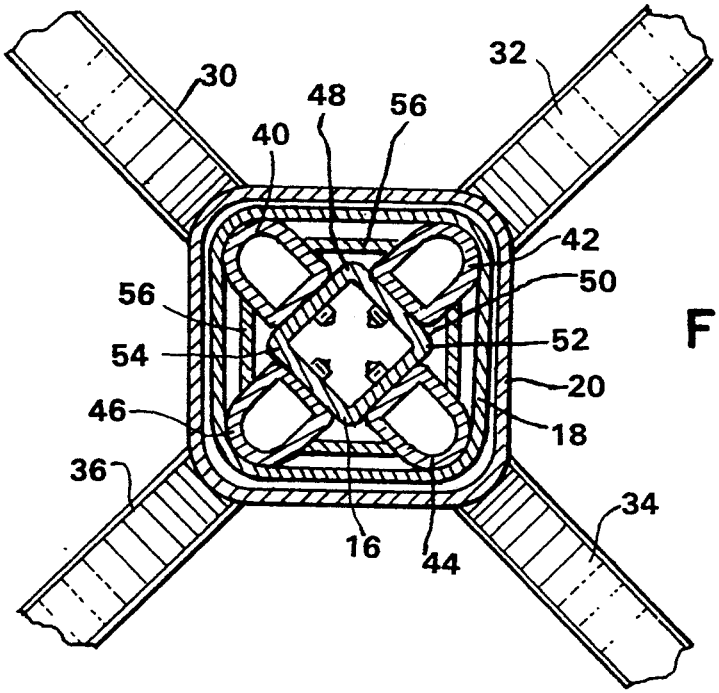
FIG. 4 is a cross-sectional view of a base taken along plane IV—IV in FIG. 3.

The reference numeral 10 (FIG. 1) generally designates a table incorporating the present invention. Table 10 includes pedestal-type base 12, which supports table 10 both during transporting of the table, as illustrated in FIG. 1, and when resting on a flat surface, such as floor 14 as illustrated in FIG. 2. The pedestal-type base 12 includes four radially extending feet 30, 32, 34, and 36 (all four of which are shown in FIG. 4) positioned at 90° increments around a center column 16. Pedestal-type base 12 also includes a base housing 18 (FIG. 1) which is telescopically received within high-low housing member 20 of a height adjustment module 21. Height adjustment module 21 is used to adjust the height of table top 22. High-low housing member 20 is affixed to table top 22 and houses pivotally mounted upper guide plate 24 (FIG. 5) and lower guide plate 26. Guide plates 24 and 26 firmly engage center column 16 at vertically spaced locations such that table top 22 is stable and rigidly supported on base 12 in a manner which resists twisting and racking forces.

Figure 3:
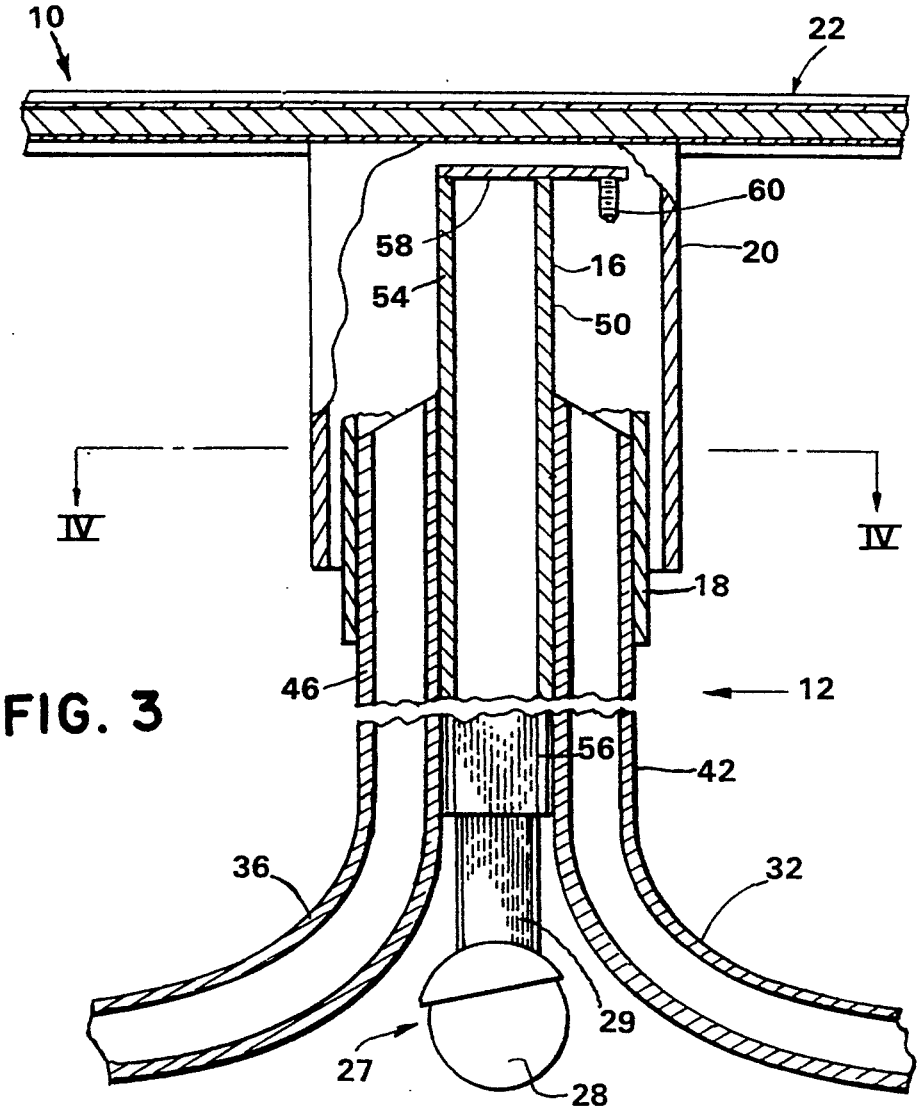
FIG. 3 is a broken-away, side elevational view of a high-low adjustment module of the table in FIG. 1.

The illustrated embodiment of table 10 is an institutional version which is particularly designed for use in hospitals, nursing homes, and the like. Table 10 includes a retractable caster assembly 27 including a caster 28 mounted to center leg 29 (FIG. 3) which facilitates manual transporting of table 10 from one location to another. The retractable center caster assembly is preferably the caster assembly disclosed in U.S. Pat. No. 4,805,542 entitled TABLE issued to Peterson et al. on Feb. 21, 1989, and U.S. Pat. No. 4,828,208 entitled VERTICALLY ADJUSTABLE TABLE WITH RETRACTABLE CASTER ASSEMBLY issued to Peterson et al. on May 9, 1989, the disclosures of which are incorporated herein by reference. However, it will be recognized that the table top mounting apparatus of the present invention may be advantageously utilized in other tables used in other environments.

The illustrated pedestal-type base 12 of table 10 includes four feet 30 (FIG. 4), 32, 34 and 36 integrally formed with legs 40, 42, 44 and 46. Glides 31 (FIG. 1) are supported on feet 30, 32, 34, and 36 to facilitate transporting of table 10. Legs 40 (FIG. 4), 42, 44 and 46 are attached to a center column 16 such that feet 30, 32, 34, and 36 extend radially outward at 90° intervals. The center column 16 is an elongated support member extending upwardly from base 12. The legs are secured to the exterior surfaces 48, 50, 52, 54 of center column 16 using suitable conventional connecting means such as welding, screws (as illustrated in FIG. 4), bolts, or the like. Leg housing 18 has a generally square cross-sectional configuration with open ends for receiving legs 40, 42, 44 and 46 and center column 16. Four cover strips 56 (only two of which are numbered) are attached to and extend diagonally between adjacent legs 40, 42, 44 and 46. Cover strips 56 extend between medial portions of legs 40, 42, 44, 46 and serve to create a neat, sleek appearance for pedestal base 12. Details of the construction of pedestal-type base are disclosed in U.S. Pat. Nos. 4,838,208 and 4,805,542 incorporated hereinabove by reference.

A mounting plate 58 (FIG. 3) is securely affixed to the top of center column 16. Mounting plate 58 may be attached to center column 16 by any suitable conventional means such as welding or the like. A high-low screw 60 extends downwardly from mounting plate 58 in parallel with center column 16. High-low screw 60 is fixedly secured to mounting plate 58 by conventional means. High-low screw 60 includes threads on an outer surface thereof which are utilized by the high-low adjustment module for adjusting the height of table top 22 as described in greater detail hereinbelow.

The high-low height adjustment module 21 includes high-low housing member 20 which telescopically receives base housing 18. The height adjustment module 21 includes a height adjustment mechanism having a crank knob 62 (FIGS. 5 and 6), a crank 64, a mitered gear 66, a gear nut 69, and a yoke 68. Crank knob 62 is rotatably affixed to crank 64 by suitable conventional means. Crank 64 is coupled to mitered gear 66 by an axle (not shown). The axle is supported within yoke 68 which extends through an aperture 71 (FIG. 7) in high-low housing member 20. The yoke circumscribes high-low screw 60 and rests on a top surface of mitered gear nut 69. Yoke 68 fits snugly within aperture 71 such that housing member 20 moves with yoke 68.

In the illustrated embodiment, housing member 20 has two U-shaped housing sections 70 (FIG. 7) and 72. The housing sections are preferably metal and are constructed using any suitable conventional manufacturing method. The housing sections are preferably Joined by weldments 73 (FIG. 6) and 74 to form a rigid, integral housing member. Housing section 70 includes apertures 75-78. Housing section 72 includes apertures 79-82. Housing section 70 includes aperture 71.

Figure 6:
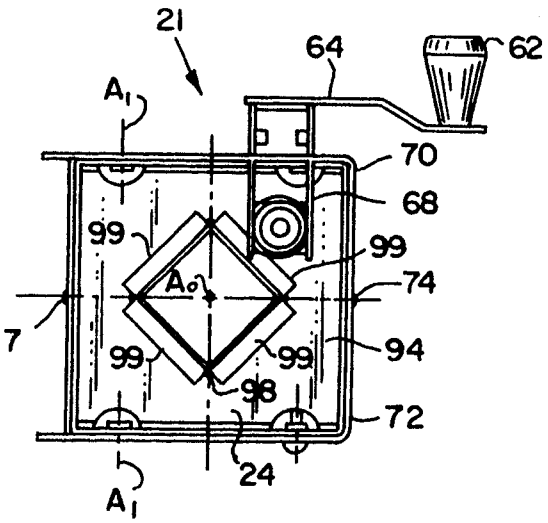
FIG. 6 is a top plan view of a high-low adjustment mechanism according to FIG. 3.

The mounting apparatus includes guide plates 24 and 26 supported on housing member 20. Plates 24 and 26 are identical and accordingly only guide plate 24 is described in greater detail hereinafter. Guide plate 24 is generally square as viewed from the top, as illustrated in FIG. 6, and includes a web 94 with a generally square central aperture 98 circumscribed by glides 99. Aperture 98 is larger than center column 16 to receive the column therein. Web 94 also includes an opening 97 (FIG. 7) for receipt of high-low screw 60. Guide plate 24 also includes orthogonal flanges 95 and 96. Flanges 95 and 96 each include spaced openings 83 for receipt of respective ones of fasteners 86–89. The guide plate is preferably metal and manufactured in a single unit using conventional methods. Upper guide plate 24 and lower guide plate 26 are attached to high-low housing member 20 by suitable conventional fasteners 86–93 which are movingly received in guide plate apertures 75–82. Apertures 76, 78, 80 and 82 are round such that fasteners 86, 88, 90 and 92 provide a fixed pivot axes for guide plates 24 and 26. Apertures 75, 77, 79 and 81 are slotted such that fasteners 87, 89, 91 and 93 slide therein when the guide plates pivot on fasteners 86, 88, 90 and 92.

Figure 9:
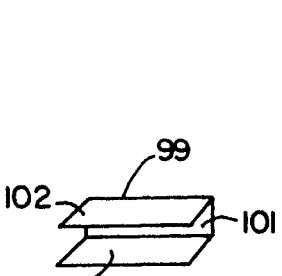
FIG. 9 is a perspective view of a glide for the guide plates.

Each glide 99 (FIG. 9) is preferably constructed from an antifriction material such as nylon or the like and has a general U-shaped lateral cross-sectional configuration. The U-shaped configuration includes a wall 101 and opposite flanges 102 and 103. The cavity formed by wall 101 and flanges 102 and 103 define a groove in which edges of aperture 98 in guide plate 24 are received so as to securely mount each glide thereon.

Figure 10:
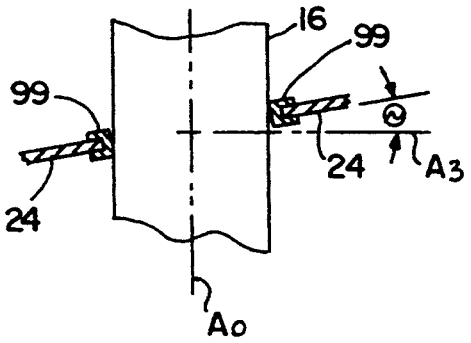
FIG. 10 is a cross-sectional view taken along claim X—X in FIG. 6.

To assemble the housing member 20 to center column 16, the guide plates 24, 26 are inserted over center column 16. The center of apertures 98 of each guide plate is aligned with longitudinal center axis $A_0$ (FIG. 6) of center column 16. Housing member 20 is then positioned over the guide plates. The guide plates are movably assembled to housing member 20 using screws 86–93. Each guide plate is pivoted to a position where the angle (FIG. 10) between the guide plate and an axis $A_3$ orthogonal to longitudinal axis $A_0$ is such that glides 99 clamp firmly onto column 16 as illustrated in FIG. 10. The exterior surface of glide wall 101 contacts the exterior faces 48, 50, 52 and 54 of center column 16 when the guide plate 24 is pivoted to a suitable angle.

Figure 8:
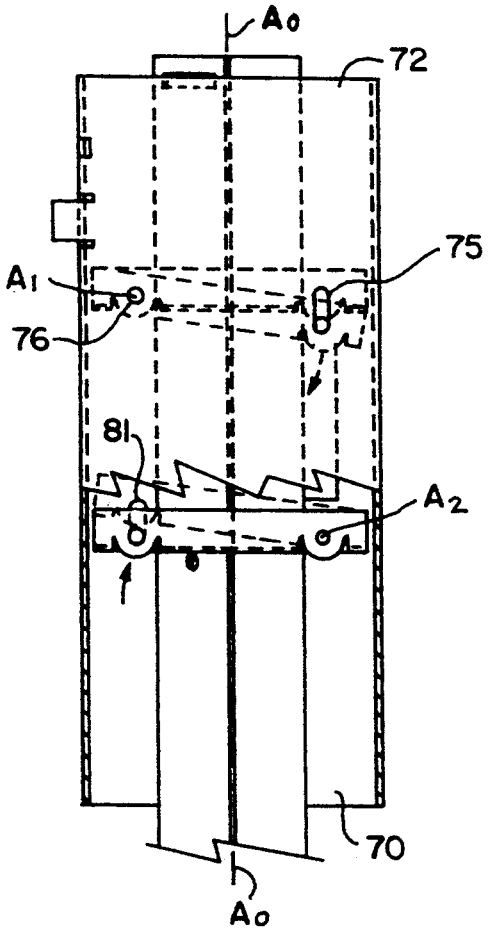
FIG. 8 is a broken away side elevational view of a high-low adjustment module according to FIG. 3.
Figure 7:
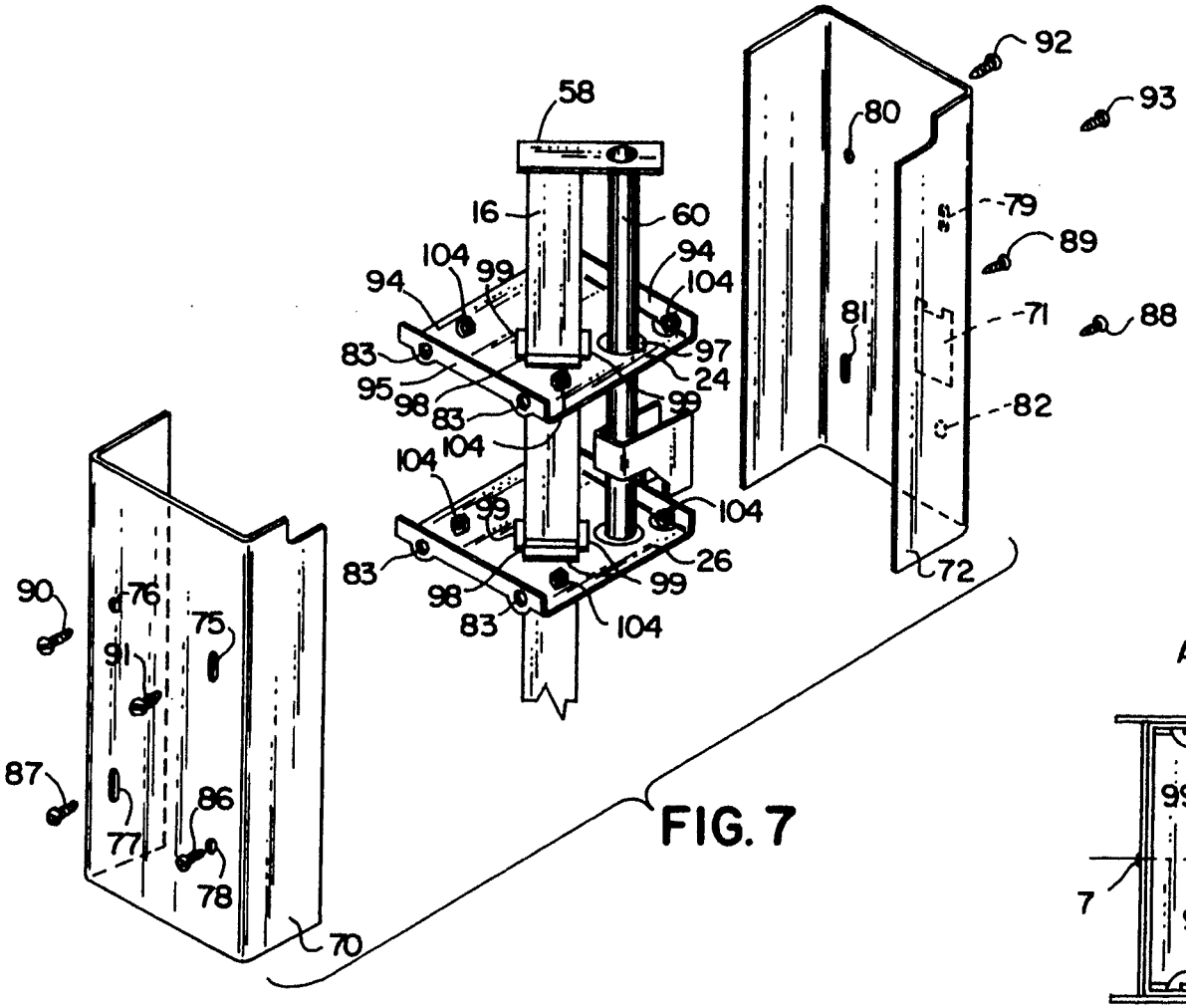
FIG. 7 is a partially exploded view of the high-low adjustment module according to FIG. 3.

Glide plate 24 pivots around an axis $A_1$ (FIG. 6) to engage center column 16. Glide plate 26 pivots around an axis $A_2$ to engage center column 16. As illustrated in FIG. 7 and 8, slots 75 and 79 are vertically spaced from and laterally aligned with pivot axis $A_2$. Slots 77 and 81 are vertically spaced from and laterally aligned with axis $A_1$. Accordingly, as best illustrated in FIG. 8, pivot axes $A_1$ and $A_2$ are on opposite sides of vertical axis $A_0$ to provide stable support for table top 22.

When the plates are positioned such that glides 99 firmly engage center column 16, screws 91, 93, 87 and 89 are locking members when they are tightened to nuts 104 as they lock the guide plates into engagement with center column 16. By pivoting the guide plates to a position where glides 99 clamp onto center column 16, the guide plates securely mount housing member 20 on center column 16 for sliding translation up and down center column 16. The pivoting of guide plates 24 and 26 converges the glides 99 on center column 16 to eliminate clearance therebetween, so that housing member 20 is snugly mounted on center column 16, yet can slidingly translate up and down along the exterior faces 48, 50, 52, and 54 thereof.

The square shape of center column 16 and rectangular aperture 98 prevents table top 22 from rotating in a horizontal plane on pedestal-type base 12. Because the guide plates are a single unit and are assembled to housing member 20 which is also a single unit, the mounting apparatus including the guide plates and housing member 20 is highly resistant to twisting and racking forces. This stability is particularly advantageous in institutional settings where the table is used as a support by patients and/or where the table includes means such as caster assembly 27 for transporting the table.

The vertical spacing of guide plates 24 and 26 on housing 20 provides two sets of four glides 99 which abut faces 48, 50, 52 and 54 of center column 16 at two vertically spaced apart locations which provides very secure lateral stability for the table top 22. This mounting arrangement, along with the clamping action of glides 99 on center column 16 imparts a very solid feel to top 22 which is free of any shake or wobble. This type of stability is particularly important when elderly patients use the marginal edge of the table as a grab bar to assist in entering and exiting their seats, especially if the table is supporting drinks or other items that can readily spill. Additionally, the one piece construction of guide plates 24 and 26, together with the welding of housing sections 70 and 72 to effectively form a one piece housing 20, provides an assembly which resists twisting and racking forces inherent to table base structures. This adds additional stability to table top 22.

Figure 5:
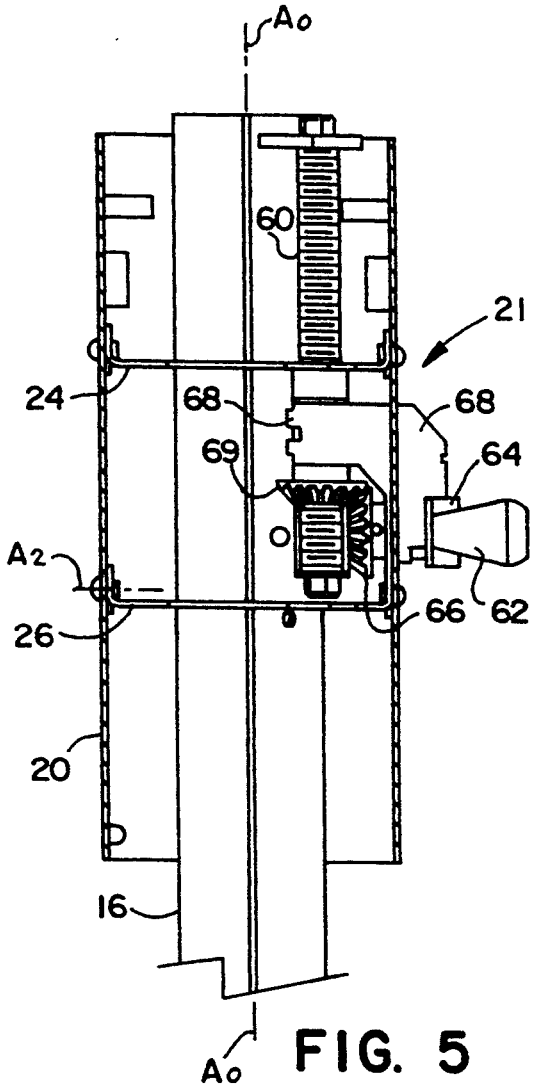
FIG. 5 is a cross-sectional view of guide plates, stationary tube, and high-low adjustment member of the high-low adjustment mechanism according to FIG. 3.

In operation, the illustrated height adjustment mechanism adjusts the position of table top 20 upon manual rotation of crank 64 (FIGS. 5 and 6). Crank 64 rotates mitered gear 66, which in turn controls gear nut 69 to rotate. Gear nut 69 rotates on the external threads of high-low screw 60 when crank 64 is rotated in a clockwise or counter clockwise direction. Yoke 68 moves vertically with gear nut 69. Housing member 20, and table top 22, move vertically with yoke 68. As described above, glides 99 slide on the center column such that the guide plates maintain a stable support for table top 22 when the housing is stationary and when it is moving relative to the base.

Accordingly, it can be seen that a mounting apparatus is disclosed which provides a stable support for a table top on a base. The mounting apparatus facilitates the use of a height adjustment mechanism which accommodates wheelchairs and the like. The height mounting apparatus provides a solid table top which is free from shake or wobble as well as being very resistant to racking and twisting forces of the table top and base. The mounting apparatus provides stable table top support for tables including casters for transporting the table on a support surface such as a floor.

In the foregoing description it will be readily appreciated by those skilled in the art that modifications may be made to the invention without departing from the concepts disclosed herein. For example, additional guide plates may be used to provide more support for the table top. It is also envisioned that the additional guide plates pivot on an axis orthogonal to the axis of the illustrated guide plates. Further, it is envisioned that the guide plate may be mounted on the base to engage a support member extending through the mounting apparatus housing. Such modifications are to be considered in the following claims, unless these claims by their language expressly state otherwise.

The embodiments of the invention in which an exclusive property or privilege is claimed are defined as follows:

1. A height adjustable table comprising:

a table top shaped to selectively support articles thereon;

a base having a first end adapted to support said table top in a generally horizontal manner and a second end adapted to support said base on a support surface;

an elongated support member carried on one of said base and said table top, said support member having a longitudinal center axis;

a housing carried on the other one of said base and said table top;

a height adjustment mechanism carried on said housing and operably coupled to said support member;

at least one guide plate including an aperture having at least one edge, said aperture being larger than said support member in order to receive said support member such that said aperture circumscribes said support member; and at least one fastener for adjustably supporting said at least one guide plate on said housing such that the angle between said guide plate and said center axis of said support member is other than ninety-degrees whereby the angular position of said guide plate is adjusted and then fixed using said at least one fastener such that said at least one edge of said aperture slidingly engages said support and said guide plate clamps said support member to support said top on said base securely while facilitating adjustment of the height of said table top.

2. The adjustable table as defined in claim 1 wherein said housing is carried on said table top and said support member is carried on said base.

3. The adjustable table as defined in claim 1 wherein said at least one guide plate includes at least two guide plates and said at least one fastener includes a plurality of fasteners, each of said at least two guide plates supported on said one of said base and said housing by respective ones of said plurality of fasteners.

4. The adjustable table as defined in claim 3 wherein each of said guide plates are supported on said housing in vertically spaced relation to engage said support member at spaced locations along its length.

5. The adjustable table as defined in claim 4 wherein said respective ones of said fasteners which support said first and second guide pates provide a respective pivot axis for each of said first and second guide plates and locks the position of each said guide plates on said housing.

6. The adjustable table as defined in claim 1 wherein said housing is formed from two housing sections which are juxtaposed and joined along their length to form a rigid housing.

7. The adjustable table as defined in claim 6 wherein said housing sections are welded together.

8. The adjustable table as defined in claim 1 wherein said housing is carried on said table top and a high-low screw is carried on said base member, said height adjustment mechanism operably coupled to said high-low screw for adjusting the height of said table top.

9. A mounting apparatus for supporting an element on an elongated support member having a longitudinal center axis, the mounting apparatus including:

a housing adapted to be attached to the element;

a height adjustment mechanism on said housing and adapted to be operably coupled to said elongated support member to adjust the height of the element relative to the elongated support member;

at least one guide plate including an aperture having an edge, said aperture being larger than the elongated support member and receiving the elongated support member such that said aperture circumscribes the support member; and at least one fastener for movably and lockingly supporting said at least one guide plate on said housing whereby the angular position of said guide plate is adjusted to an angle other than orthogonal relative to said housing and said support member wherein said edge of said aperture engages the support member and the guide plate clamps the support member when the mounting apparatus is mounted on the support member and said angle of said guide plate is locked using said at least one fastener to securely support said housing on the base.

10. The mounting apparatus as defined in claim 9 wherein said at least one guide plate includes two guide plates and said at least one fastener includes a plurality of fasteners, each of said guide plates having a respective aperture, said two guide plates movably supported on said housing by respective ones of said plurality of fasteners.

11. The mounting apparatus as defined in claim 9 wherein said at least one guide plate is supported on said housing in generally parallel spaced relation to engage the support member at spaced locations along the length of said support member.

12. The mounting apparatus as defined in claim 9 wherein said at least one fastener for supporting said first and second guide plates provide a respective pivot axis for each of said first and second guide plates.

13. The mounting apparatus as defined claim 9 wherein said housing is an integral unit.

14. A mounting apparatus for adjustably supporting a table top on a base of the type including an elongated support member having a longitudinal center axis, the mounting apparatus including:

a housing adapted to be attached to the table top;

a guide plate including an aperture having an edge, said aperture being larger than said elongated support member to receive the elongated support member such that said aperture circumscribes said support member;

a height adjustment means positioned in said housing and operably coupled to said support member for adjusting the height of the table top relative to the base; and attachment means operably connected to said guide plate and said housing for adjustably supporting said guide plate on said housing and adjusting the angle of said guide plate relative to said housing so that the position of said guide plate may be adjusted to an angle relative to said housing and the support member wherein said edge of said aperture firmly engages the support member and the guide plate clamps the support member when the mounting apparatus is mounted on the support member to support said housing securely on the base.

15. The mounting apparatus as defined in claim 14 further including another guide plate and each of said guide plates having a respective aperture, said guide plates being movably supported on said housing by respective attachment means.

16. The mounting apparatus as defined in claim 15 wherein each of said guide plates is supported on said housing generally in parallel spaced relation to engage the support member at spaced locations along the length of said support member.

17. The mounting apparatus as defined in claim 16 wherein said attachment means for supporting said guide plates provide a respective pivot axis for each of said guide plates.

18. The mounting apparatus as defined in claim 17 wherein the respective pivot axes of said guide plates are on opposite sides of said longitudinal center axis of said support member.

19. The mounting apparatus as defined in claim 14 wherein said housing is an integral unit.

20. The mounting apparatus as defined in claim 19 wherein said housing includes sections which are welded together to form an integral unit.

* * * * *

UNITED STATES PATENT AND TRADEMARK OFFICE

CERTIFICATE OF CORRECTION

PATENT NO. : 5,365,862
DATED : November 22, 1994
INVENTOR(S) : Warren J. Peterson It is certified that error appears in the above-indentified patent and that said Letters Patent is hereby corrected as shown below:

In the Abstract, line 1:

After "top on" insert – a base –.

Col. 2, line 19:

"references following" should read – reference to the following –.

Col. 4, line 19:

"Joined" should read – joined –.

UNITED STATES PATENT AND TRADEMARK OFFICE

CERTIFICATE OF CORRECTION

PATENT NO. : 5,365,862
DATED : November 22, 1994
INVENTOR(S) : Warren J. Peterson It is certified that error appears in the above-indentified patent and that said Letters Patent is hereby corrected as shown below:

Col. 6, line 52:

After "support" insert – member –.

Col. 7, line 3:

"pates" should read – plates –.

Signed and Sealed this

Third Day of October, 1995

*Attest:*

Bruce Lehman

BRUCE LEHMAN

*Attesting Officer*

*Commissioner of Patents and Trademarks*